United States Patent [19]

Chatterjee

[11] Patent Number: 5,000,796

[45] **Date of Patent: * Mar. 19, 1991**

[54] ANISOTROPIC HIGH ENERGY MAGNETS AND A PROCESS OF PREPARING THE SAME

[75] Inventor: Dilip K. Chatterjee, Rochester, N.Y.

[73] Assignee: Eastman Kodak Company, Rochester, N.Y.

[ * ] Notice: The portion of the term of this patent subsequent to Jan. 9, 2007 has been disclaimed.

[21] Appl. No.: 159,160

[22] Filed: Feb. 23, 1988

[51] Int. Cl.[5] ..... H01F 1/02

[52] U.S. Cl. ..... 148/101; 148/104; 419/12; 419/67; 419/41; 72/253.1; 72/700

[58] Field of Search ..... 148/101, 104; 72/253.1, 72/700; 419/12, 67, 41

[56] References Cited

U.S. PATENT DOCUMENTS

| | | | |
|---|---|---|---|
| 2,792,301 | 5/1957 | Bungardt | 72/253.1 |
| 3,236,633 | 2/1966 | Bungardt | 72/253.1 |
| 4,374,665 | 2/1983 | Koon | 75/123 |
| 4,402,770 | 9/1983 | Koon | 148/31.57 |
| 4,496,395 | 1/1985 | Crost | 75/123 |
| 4,585,473 | 4/1986 | Narasimhan | 75/0.5 |
| 4,597,938 | 7/1986 | Matsuura et al. | 419/23 |
| 4,601,875 | 7/1986 | Yamamoto et al. | 419/23 |
| 4,684,406 | 8/1987 | Matsuura et al. | 75/244 |

FOREIGN PATENT DOCUMENTS

| | | | |
|---|---|---|---|
| 0101552 | 2/1984 | European Pat. Off. . | |
| 0106948 | 5/1984 | European Pat. Off. . | |
| 0108474 | 5/1984 | European Pat. Off. . | |
| 0125347 | 11/1984 | European Pat. Off. . | |
| 0133758 | 3/1985 | European Pat. Off. . | |
| 0187538 | 7/1986 | European Pat. Off. | 148/302 |

OTHER PUBLICATIONS

"Radially Oriented NdFeB Magnets", Bao-Min Ma, V. K. Chandhok, and E. J. Dulis—1987 Digest of Intermag Conference, Tokyo, Japan, Apr. 14–17, 1987.

"NdFeB Magnets Having a (100) Fiber Texture", B. M. Ma, R. F. Krause and V. Chandhok, Proceedings of the 9th International Workshop on Rare Earth Magnets and Their Application, Bad Soden, FRG, Aug. 31–Sep. 2, 1987—pp. 545–551.

*Primary Examiner*—John P. Sheehan

*Attorney, Agent, or Firm*—Robert A. Gerlach

[57] ABSTRACT

A process of making anisotropic permanent magnets by extruding a rare earth magnetic alloy below the melting temperature of the alloy at an extrusion ratio of from 10:1 to 26:1.

5 Claims, 1 Drawing Sheet

ANISOTROPIC HIGH ENERGY MAGNETS AND A PROCESS OF PREPARING THE SAME

FIELD OF THE INVENTION

This invention relates to high energy permanent magnets having a high degree of anisotropic alignment and to a method of preparing the same. More particularly, this invention relates to a method of preparing permanent anisotropically aligned magnets of rare earth transition metal alloys.

BACKGROUND OF THE INVENTION

Many rare earth-transition metal alloys are known in the art to form high energy permanent magnet materials. Samarium cobalt magnets have received much attention, however, because of economic considerations the trend has been toward other more plentiful and therefore cheaper materials. Alloys of neodymium and or praseodymium are particularly suitable from both the properties standpoint and from the economic standpoint. Particularly suitable alloys of this class are those where the particular rare earth is combined with iron and boron. European Patent Application No. 0 108 474 published May 16, 1984 teaches a method of making isotropic magnets by hot pressing of melt spun ribbons. European Patent Application No. 0 133 758 published July 11, 1984 has as one of its objects to provide a fully densified fine grain, anisotropic, permanent magnet formed by hot working a suitable material comprising iron, neodymium and or praseodymium and boron.

While these magnets show some degree of anisotropy, as evidenced by the second quadrant demagnetization curve wherein remanence in the preferred direction is compared with the remanence far removed from the preferred direction, it is significantly less than two in all examples shown. In addition, the technique employed to obtain the degree of anisotropy obtained is expensive and requires machining of the magnets for applications such as use in rotating machines including stepping motors, multipole rotors; beam focusing devices, magnetic electrographic development rollers and the like where the magnets preferably should possess anisotropic properties in the radial direction.

SUMMARY OF THE INVENTION

The present invention provides a method of making anisotropic permanent magnets of a rare earth magnetic alloy by extruding the alloy at a temperature below the melting point thereof and at an extrusion ratio of from above 10 to 1 to about 26 to 1. By control of the extrusion temperature, the extrusion ratio and the shape of the extrusion orifice, the preferred alignment of the fully dense magnets can be predetermined and controlled. For example, should it be desired to produce a cylinder or a hollow roller having anisotropic properties in the radial direction the rare earth alloy can be extruded through a circular orifice or an annular ring orifice to obtain preferred alignment.

DETAILED DESCRIPTION OF THE INVENTION

Figure 1:
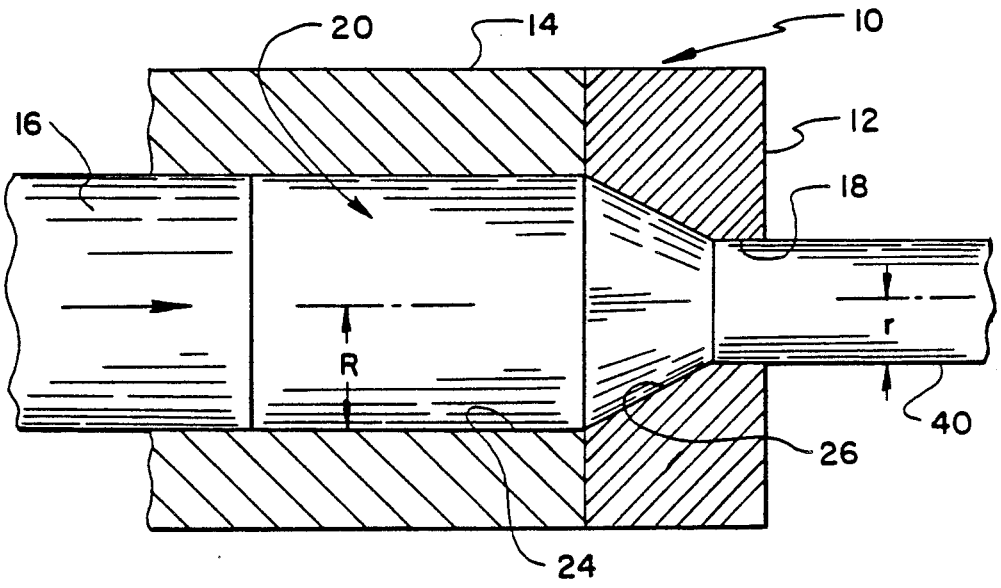
FIG. 1 is a diagrammatic illustration of the operative portion of an extrusion apparatus suitable for use in the practice of this invention.

The invention contemplates the preparation of fully dense anisotropic permanent magnets utilizing a rare earth magnetic alloy as the starting component by extruding this material at a temperature below the melting point of the alloy and preferably at a temperature of about 600° C. to about 1,000° C. and at an extrusion ratio of from about 10:1 to 26:1 and preferably from about 12:1 to about 18:1 to achieve anisotropic fully dense permanent magnets. The preferred direction of orientation depends upon the shape of the orifice through which the alloy is extruded and the forces applied on the alloy by the orifice as the alloy is forced through the orifice. The orifice may have any desirable cross-sectional geometric configuration including circular, rectangular, including square, triangular, hexagonal, octagonal, trapezoidal, etc. When a cylindrical extrusion is prepared, the grain orientation i.e. the preferred orientation of the crystallites is in the radial direction. Should the alloy be extruded through a slot having a greater width than height, the preferred orientation will be in the direction normal to the longest dimension of the slot. By "extrusion ratio" is meant the ratio of the cross-sectional area of the barrel of the extrusion device to the cross-sectional area of the orifice through which the alloy is forced. While it is contemplated that any suitable cross sectional configuration may be extruded in accordance with this invention, and that the ram may have any suitable cross sectional configuration whether corresponding to the shape of the orifice or not, throughout the remainder of this application, when speaking of these characteristics cylindrical extrusions will be particularly referred to and an extrusion device having a cylindrical ram will be spoken of.

In the preparation of a high energy anisotropic permanent magnets, any suitable rare earth alloy having permanent magnetic properties may be used such as, for example, rare earth transition metal alloys. Examples of suitable rare earth elements include for example samarium, neodymium, praseodymium, lanthanum, cerium, tytrium, terbium, mischmetal and the like. Neodymium and praseodynium are preferred and neodymium is particularly preferred. Combinations of any of the above rare earth elements may be employed. Of the transition metals, iron, cobalt, and nickel are particularly suitable and iron is particularly preferred. Neodymium iron boron alloys are particularly suitable for use in the method of this invention because of the good magnetic qualities obtained when using such alloys. Particularly suitable neodymium iron boron alloys are those which form the $Nd_2Fe_{14}B$ phase which is the main magnetic phase in neodymium iron boron alloys that gives rise to magnets having the highest properties when anisotropically aligned.

The magnetic rare earth alloy to be used in accordance with this invention may be formed by any suitable technique including casting, casting followed by particle size reduction including grinding and the like, atomizing or melt spinning. Alloys prepared by melt spinning technique are preferred for use as extrusion materials in accordance with this invention. The method and apparatus employed for preparing melt spun ribbons for use in accordance with this invention are described in U.S. Pat. No. 4,402,770 issued Sept. 6, 1983, and in application Ser. No. 159,637 filed on even date herewith, assigned to the same assignee as this application, entitled "A Method of Preparing Neodymium-Iron-Boron Magnets Having Anisotropic Alignment And A Uniform Grain Size" by T. W. Martin and D. K. Chatterjee, both incorporated fully herein by reference.

To achieve superior properties by this extrusion method, the rare earth alloy should have a crystallite grain size of from about 500 to about 2000 Å preferably from about 1500 to about 2000 Å and most preferably from about 1700 to about 1900 Å. By utilizing alloy compositions having this narrow range of grain size, a higher degree of anisotropic alignment results as evidenced by the ratio of the remanence in the radial direction (normal to the extrusion direction) to the remanence in the axial direction (the extrusion direction).

The grain size is measured by use of a transmission electron microscope using the following procedure. In this procedure typical melt spun ribbons were glued to stainless steel polishing blocks. The glued surfaces being the surfaces adjacent to the wheel surface. Mechanical polishing was performed to a varying degree to reduce the thickness of the ribbons. Finally the ribbons were removed from the polishing blocks and ion milled to a electron transparent thickness. These ribbons were examined under a transmission electron microscope operated at 120 KV. Electron micrographs were obtained from the representative areas of the thinned ribbons and the grain size was determined by averaging the grain size from the wheel surface throughout the ribbon thickness to thee top surface.

The cystallite grain size of the magnetic alloy can be controlled during the preparation thereof by a number of techniques. For example, in the melt spinning technique the speed of the wheel and thereby the rate of quenching the formed ribbons can be altered and this in turn will affect the size of the crystallite grains. As the speed of the wheel is increased and thus the quench rate is increased, the grain size generally becomes smaller. As the quench rate increases, the resulting alloy approaches an amphorous nature. This type of material may be processed by techniques such as, annealing hot working and the like to increase the grain size. A preferred method of obtaining a magnetic alloy of the essential grain size is to melt spin an alloy containing a small amount, preferably 2 to 6 atomic percent of a doping element such as, Ti, Nb, V, Ta, Cr, Mo, Zn, W, Mn, Al, and Zr, and Hf. Utilizing small amounts of an additional element permits a relationship between wheel speed, the mass flow rate that the alloy flows onto the wheel and the grain size that is established. From this relationship, the parameters to achieve the desired grain size can be chosen. Further, this technique results in a starting alloy for the extrusion process of more uniform grain size, as is described in the aforementioned U.S. application Ser. No. 159,637 which discloses and claims a method of making permanent magnets by controlling the grain size. Utilizing a starting composition of controlled grain size in an extrusion process is an improvement invention over that claimed herein and forms the basis for copending U.S. application Ser. No. 159,636, filed on even date herewith entitled "Method of Making Anisotropic High Energy Magnets" by D. K. Chatterjee and assigned to the same assignee as this application.

Extrusion is a process by which a block of material, whether in the billet or powdered form is reduced in cross section by forcing it to flow through a die orifice under high pressure. Reference will be made to FIG. 1 in further describing this extrusion process. An extrusion apparatus 10 is comprised of a die portion 12 a barrel or liner 14 and a ram 16. The die portion 12 contains an orifice 18, which in the case shown defines a cylinder having a radius r. The die portion 12 together with the barrel portion 14 and the ram 16 defines an internal cavity 20, which is made up of a truncated conical portion 26 and a cylindrical portion 24. The cylindrical portion 24 has a radius R. The extrusion ratio is defined on the ratio of the cross-sectional area of the cylindrical portion 24 to the cross-sectional area of the orifice 18 or simply $R^2/r^2$.

In the practice of the process of this invention, the rare earth magnetic alloy material is inserted into a can which when assembled conforms to the internal configuration of cavity 20 of extrusion device 10. The can can be made of any suitable material, such as for example mild steel, stainless steel, and the like. The can is made up of two portions, a cylindrical portion 24 and a truncated conical portion 26 which is closed off (not shown) at the narrow end when in its original condition as inserted into the cavity 20. After insertion of the rare earth magnetic alloy into the interior of the can, the conical portion 26 is joined to the cylindrical portion 24 by any suitable technique such as welding.

The purpose and function of the can is to hold the ribbon/powdered material and also to prevent the corrosion of the rare earth magnetic alloy as it is generally of a highly corrosive nature. This is particularly true when the particles size of the rare earth magnetic alloy as it is initially inserted into the can is reduced.

In order to achieve fully dense extruded magnets it is advantageous to add to the cavity 20, at the leading edge of the magnetic alloy material to be extruded, an oxygen getter in an amount sufficient to prevent the oxidation of the magnetic alloy. Preferably up to about 5% based on the weight of the rare earth magnetic alloy should be used. This oxygen-getter may be in the form of powder, turnings, chips or the like and prevents the oxidation of the rare earth magnetic alloy. Any suitable oxygen-getter can be used such as, for example, cerium, mischmetal, magnesium, calcium, lanthanum, or any of the rare earth metal elements, titanium, tantalum or mixtures of any of the above and the like. Titanium is the preferred oxygen-getter material because of its placement in the electromotive force series. The size of the getter particles is not critical but preferably ranges from an average size of about 5 micrometers to about 30 micro meters, most preferably from 5 to 10 micrometers should be used. While the thickness of the oxygen-getter material on the face of the rare earth magnetic alloy material is not critical, it is preferred that it entirely blankets the face of the alloy preferably to a thickness of from about 2 to 5 millimeters. This is an improvement over that claimed herein and forms the basis for copending U.S. application Ser. No. 159,635 filed on even date herewith entitled "Method of Making Fully Dense Anisotropic High Energy Magnets" by D. K. Chatterjee and assigned to the same assignee as this application.

All the materials are placed in the cylindrical portion 24 of the can, and cold compacted by the application of pressure of about 40 Kpsi. The conical portion 26 is welded to the cylindrical portion 24 and, the entire assembly is degased by subjecting it to vacuum of from about $10^{-3}$ to about $10^{-5}$ Torr while heating to a temperature of from about 300° C. to about 500° C. for a period of time from about 1 to about 2 hours. At this time, the top of the truncated conical portion is welded in order to seal the materials therein. If desired, the cavity of the extrusion device can be prelined with a high temperature lubricant such as graphite, molybdenum disulfide, and the like. Finally, the sealed can together with the contents which have been preheated to the desired extrusion temperature of from about 600° C. to about 1,000° C. and preferably from about 650° C. to about 950° C. are inserted into the cavity 20 of extrusion device 10 and extruded through the die or orifice 18 by actuation of the ram 16. As is shown in FIG. 1 the extruded mass is comprised of the magnetic alloy clad with the material from which the can is made. This cladding may be removed or permitted to remain in place to serve as protection from corrosion of the magnetic alloy.

The invention will be further illustrated by the following examples:

EXAMPLE 1

Preparation of the Magnetic Alloy for Extrusion

The constituents of an alloy having the composition $Nd_{15}$ $Fe_{73}$ $Al_4$ $B_8$ (90 parts of weight Nd, 190 parts by weight Fe 5.2 parts by weight Al and 4 parts by weight B) are weighed out into a crucible and heated, to 1550° C. by induction for 20 minutes. The contents of the crucible are cast into a water cooled copper mold.

The contents of the copper mold are ground and placed into a quartz melt spinning apparatus generally as described in U.S. Pat. No. 4,402,770 (incorporated herein by reference). The quartz crucible has a diameter of 30 mm and the orifice at the bottom of the crucible a diameter of 1.4 mm. The chamber surrounding the melt spinning apparatus is evacuated to 50 milliTorr and then filled with argon to a pressure of about 760 milliTorr. The alloy charge is heated inductively to about 1550° C. and ejected by a force exerted by a pressure of 3 PSI of argon inside the crucible through the orifice onto a copper quench wheel having a diameter of about 12 inches rotating at 800 rpm (12.6 m/sec). The orifice is positioned about 27 μm above the cooper wheel. The ribbons of alloy obtained from the wheel exhibit an average crystallite grain size, as measured by Transmission Electron Microscope of 1800 Angstroms.

EXAMPLE 2

Extrusion of Magnetic Alloy

Melt spun ribbons prepared in accordance with Example 1 are placed in a mild steel can having a cylindrical portion 24 and a separate truncated conical portion 26 as shown in FIG. 1. The ribbons inside the cylindrical portion of the can are packed by applying pressure of about 40,000 psi and about 5% by weight, based on the weight of the alloy ribbons of titanium turnings are placed in the can over the ribbons.

Figure 2:
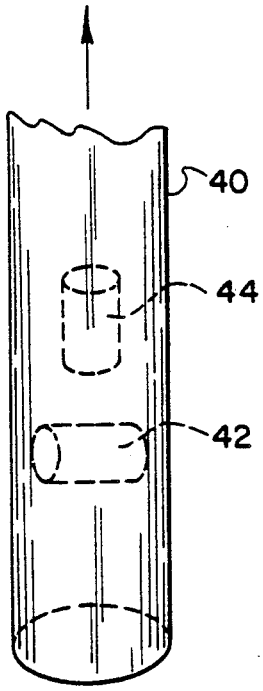
FIG. 2 is a diagrammatic view of an extruded magnetic alloy illustrating the direction in which samples are cut for the measurement of anisotropy.
Figure 3:
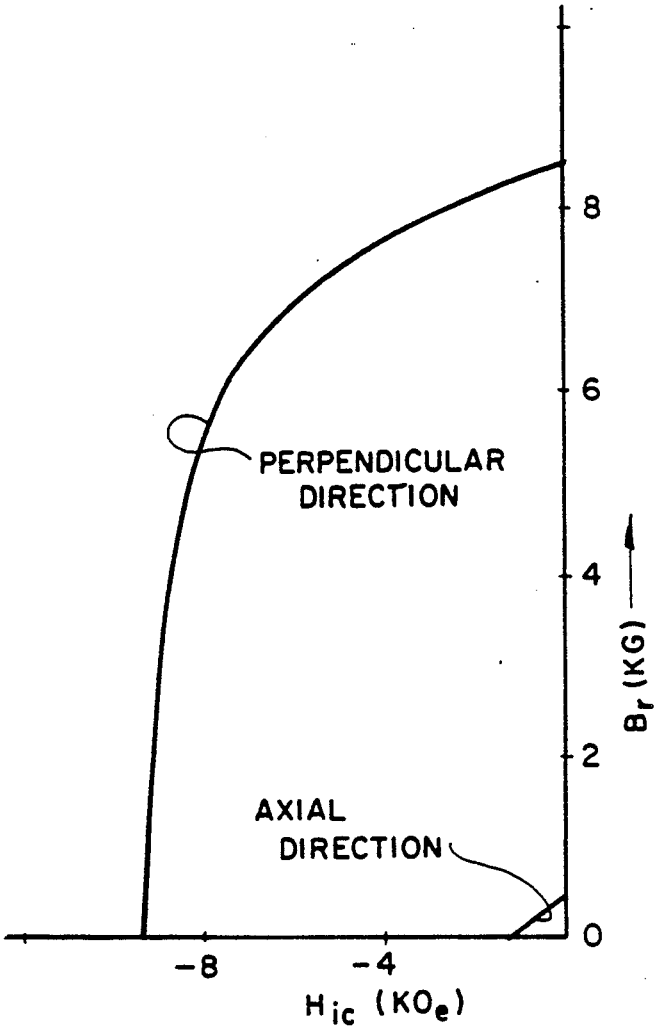
FIG. 3 is a second quadrant demagnetization curve of a sample taken transverse to the direction of extrusion and a sample in the direction of extrusion.

The truncated portion 26 is next welded to the cylindrical portion. The can has of a wall thickness of ⅛ inch and outside diameter of 2 inches. The can containing the ingredients as indicated above is evacuated at a pressure of $10^{-4}$ Torr. and heated to a temperature of 400° C. to facilitate degassing. When this vacuum is reached, the top of the truncated portion is welded by means of an oxyacetylene torch to seal the contents. The sealed structure containing the alloy and titanium filings is heated to 650° C. by placing in a preheated furnace maintained at that temperature. After one hour at 650° C. the hot can is transferred to a 300 ton extrusion press fitted with a 2.04 inch diameter lining and an tool steel die of 0.5 inch diameter. The extrusion ratio for this arrangement was 16:1. The liner is coated with graphite sold under the trade name "Polygraph" by United International Research Corporation. The extrusion is conducted at peak force of 310 tons by hydraulic activation of the ram. The extruded product in the shape of a rod is quenched in water maintained at room temperature. The finished extruded product 40, as shown in FIG. 2, is obtained by removing the mild steel can from the outer surface of the fully dense alloy. A cylindrical section 42 was taken from the extrudate in a direction transverse to the extrusion direction and a second cylindrical section 44 taken in the direction axially aligned with the extrusion direction. The two cylindrical sections are each magnetized along the axis of the cylinder by subjecting each to a pulsed magnetic field having a strength of about 40 kilooersteds. Each cylindrical section is then individually characterized using a magnetic hysteresigraph in conjunction with a custom made annular pick-up fixture and an electromagnet. Pure Ni, in annealed condition, is used as a standard for calibration of the equipment. The second quadrant demagnetization curves, as shown in FIG. 3 is obtained by this technique. It can be readily seen that the remanence Br in the direction perpendicular to the extrusion direction is approximately 8.8 kilogauss while the remanence of the sample taken in the direction of extrusion or axial direction is approximately 0.5. kilogauss. The remanence ratio therefore is equal to about 17.6 which indicates an extremely high radial anisotropy in the extruded magnetic material.

The immediately preceding example was repeated varying the extrusion temperature and the extrusion ratio. Examples were conducted at 640° C., 675° C., 700° C., 750° C., 850° C., 900° C. and 950° C. at extrusion ratios of 12:1, 18:1 and 26:1. In all cases the extruded magnetic material exhibited extremely high radial anisotrophy.

It is to be understood that throughout the examples, other materials and conditions can be employed rather than those recited therein. For example, other die materials such as tungsten carbide, diamond or other high strength, high temperature materials may be used. The can material may be made from other materials including stainless steel and the like suitable to serve as non corrosive protective layers on the magnets themselves. The type of lubricant as well as the extrusion pressure may be varied to obtain similar results. Other rare earth magnetic alloys may be utilized in the process described herein as illustrated previously.

I claim:

1. A process of making anisotropic permanent magnets which comprises extruding a rare earth transition metal magnetic alloy at a temperature of from about 600° C. to about 1000° C. at an extrusion ratio of from about 10:1 to about 26:1.

2. The process of claim 1 wherein the rare earth magnetic alloy is an alloy of neodymium, iron and boron.

3. The process of claim 2 wherein the main magnetic phase in the magnetic alloy is $Nd_2Fe_{14}B$.

4. The process of claim 1 wherein the extrusion ratio is from 12:1 to 18:1.

5. The process of claim 1 wherein the cross-section of the extrudate is circular and the crystalline alignment is radial.

* * * * *